US012144473B2

(12) United States Patent
Ruggiero et al.

(10) Patent No.: US 12,144,473 B2
(45) Date of Patent: Nov. 19, 2024

(54) TOILET SEAT AND CHAIR

(71) Applicant: Sunny Days Entertainment, LLC, Simpsonville, SC (US)

(72) Inventors: Jim Ruggiero, Simpsonville, SC (US); Ka Shun Lo, Tsuen Wan (HK)

( * ) Notice: Subject to any disclaimer, the term of this patent is extended or adjusted under 35 U.S.C. 154(b) by 134 days.

(21) Appl. No.: 18/092,258

(22) Filed: Dec. 31, 2022

(65) Prior Publication Data

US 2024/0215775 A1 Jul. 4, 2024

(51) Int. Cl.
*A47K 13/06* (2006.01)

(52) U.S. Cl.
CPC ..... *A47K 13/06* (2013.01)

(58) Field of Classification Search
CPC ..... A47K 13/06
USPC ..... 4/239
See application file for complete search history.

(56) References Cited

U.S. PATENT DOCUMENTS 1,156,629 A * 10/1915 Rivera ..... A47K 13/06 4/239
1,410,427 A * 3/1922 Turnquist ..... A47K 13/06 4/239
2,443,068 A * 6/1948 Dahle ..... A47K 13/06 D23/311
5,787,514 A * 8/1998 Erli ..... A47K 13/06 4/239
D621,489 S 8/2010 Tu
D697,189 S 1/2014 Rathbone
D724,711 S 3/2015 Capraro et al.
D771,227 S 11/2016 Yeung
D834,159 S 11/2018 Appelbaum
10,478,024 B2 11/2019 Duke et al.
D903,839 S 12/2020 Stroikov
D904,584 S 12/2020 Stroikov
11,647,874 B2 * 5/2023 Aparicio ..... A47K 13/005 4/239
2007/0017012 A1 * 1/2007 Greenspon ..... A47K 13/005 4/239
2016/0242606 A1 * 8/2016 Jackson ..... A47K 13/005
2021/0361129 A1 * 11/2021 Bailey ..... A47K 13/06

* cited by examiner

*Primary Examiner* — Huyen D Le
(74) *Attorney, Agent, or Firm* — Waddey Acheson; Ira C. Waddey, Jr.

(57) ABSTRACT

A toilet seat and toilet chair with detachable seat members that can be easily removed from around a child's neck. The apparatus includes a first seat member and a second seat member, wherein the first and second seat members are detachable. The apparatus includes a first latch disposed at a first end of the second seat member between the first and second seat members, and a second latch disposed at the second end of the second seat member between the first and second seat members opposite the first latch. During use, a user may detach the first and second seat members via the first and second latches. The second seat member may be later reconnected to the first seat member via the first and second latches.

20 Claims, 10 Drawing Sheets

TOILET SEAT AND CHAIR

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to devices and methods for training young children to use the bathroom.

More particularly, the present disclosure relates to toilet chairs and toilet seats for small children. Training young children to properly use a toilet, otherwise known as "toilet training," is an essential part of early childhood development. However, young children cannot use ordinary toilets because conventional toilets are too tall and the seats are too large to accommodate the smaller size of such children. The relevant art includes a number of devices that parents and guardians use to safely and sanitarily teach children the proper steps of going to the bathroom.

One tool commonly used to train children to use a toilet is the toilet chair. Toilet chairs are small standalone seats that can be used like a toilet but are not connected to plumbing and thus are portable. They are generally shorter than normal toilets and have a seat with a smaller surface area than normal toilets so young children can easily sit on the toilet chair as an older child or an adult would sit on a normal toilet. Toilet chairs can either be formed as a single part, or different elements of normal toilets can be included or attached, such as a toilet bowl, a toilet seat, and/or a toilet seat lid. Children can sit on the toilet chair and use it as an adult would use a toilet; however, excrement cannot be flushed directly from the toilet chair.

Children's toilet seats are another commonly used toilet training tool. These toilet seats are smaller than ordinary toilet seats to accommodate the smaller size of young children and can be placed above the toilet bowl of a normal toilet, often on top of an existing normal-sized toilet seat. Thus, young children can use an ordinary toilet with the children's toilet seat and excrement can be immediately flushed from the toilet. These children's toilet seats are particularly useful for training children to always flush the toilet after use. As noted, toilet chairs sometimes have a separate removable toilet seat that can either be placed on the toilet chair or on an existing toilet but children's toilet seats need not be designed to work with both a toilet chair and a normal toilet.

Toilet chairs and children's toilet seats are often made of plastic, and, like virtually anything than a toddler can pick up, it is not uncommon for children to view these toilet training tools as toys. Young children are prone to removing children's toilet seats from either toilet chairs or ordinary toilets and playing with them. Sometimes, children may pull conventional toilet seats over their heads and around their necks. However, once the toilet seat encircles a child's neck, it generally cannot be safely removed without the use of force. Removal typically requires cutting, sawing, snapping, or otherwise breaking the toilet seat to be able to extricate the child's head and neck, all of which pose a clear risk of danger to the child. Even when the toilet seat can be removed without serious injury to the child, the act of removing the toilet seat can cause physical and emotional discomfort. Further, once the toilet seat has been cut or otherwise broken, it can no longer be used properly.

What is needed then are improvements in toilet seats and chairs, particularly for use with children.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure provides a toilet seat apparatus including a first seat member and a second seat member, wherein the first and second seat members are detachable. The apparatus includes a first latch disposed at a first end of the second seat member between the first and second seat members, and a second latch disposed at the second end of the second seat member between the first and second seat members opposite the first latch. During use, a user may detach the first and second seat members via the first and second latches. The second seat member may be later reconnected to the first seat member via the first and second latches.

One aspect of the disclosure is a toilet seat apparatus for children. The apparatus includes at least two detachably connected seat members and a generally annular aperture that extends through the apparatus when the seat members are connected. The apparatus can be portable, such that it can be placed on either an existing toilet seat or on a child's toilet chair, which can create a danger of a child using the apparatus as a toy and not for going to the bathroom. When one seat member is detached from the other, access to the aperture is provided. This provided access may be radial, such as when detaching a seat member creates a gap in the side of the apparatus, or circumferential, such that the aperture is essentially enlarged. Providing access to the aperture can allow the toilet seat apparatus to be removed from a child's neck, should a child pull the apparatus over his head and around his neck. The seat members can be in contact at two latches, and connected at one or both latches via a number of different types of connections.

Another aspect of the disclosure is a toilet chair apparatus for children. The toilet chair apparatus includes a base and a toilet seat assembly substantially similar to the toilet seat apparatus as mentioned above. The base can have a base surface configured for the toilet seat assembly to rest on the base surface. The toilet chair apparatus can also include a removable tub, which can be placed partially within the interior of the base, so that after a child uses the toilet chair the tub can be removed, emptied, and cleaned.

Numerous other objects, advantages and features of the present disclosure will be readily apparent to those of skill in the art upon a review of the following drawings and description of a preferred embodiment.

DETAILED DESCRIPTION

Figure 1:
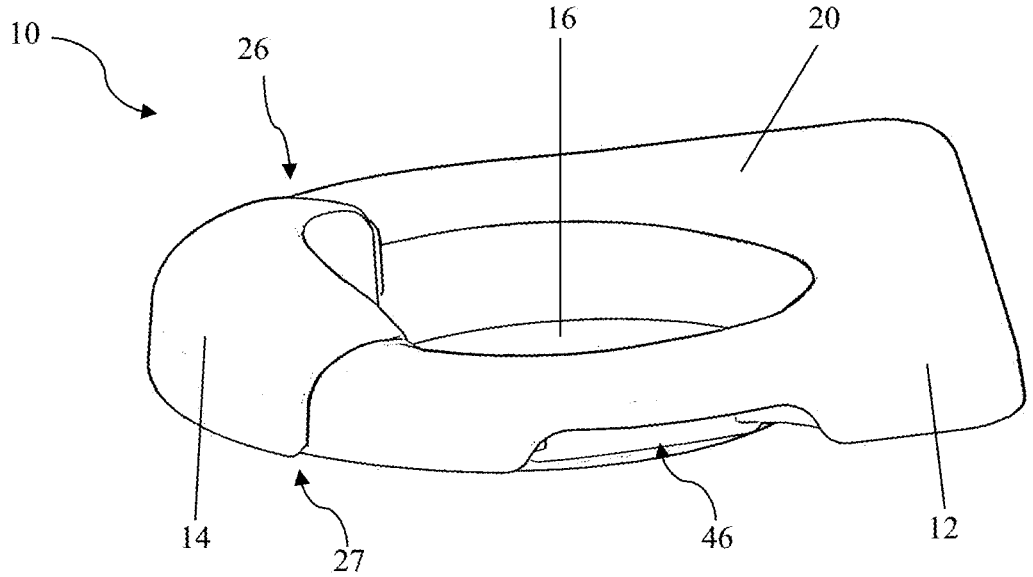
FIG. 1 is a top perspective view of an embodiment of a toilet seat apparatus of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 8:
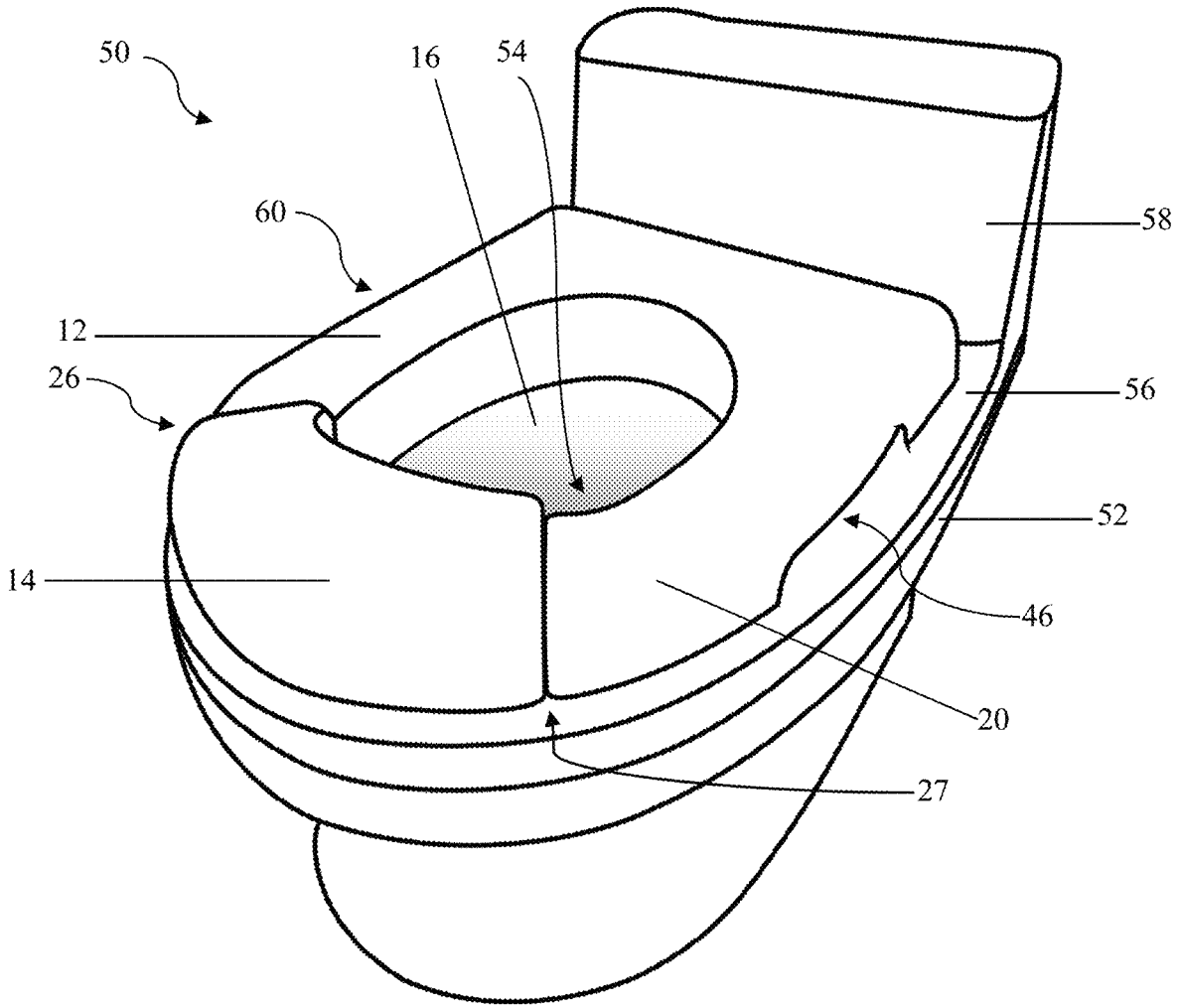
FIG. 8 is a perspective view of an embodiment of a toilet chair apparatus of the present disclosure.
Figure 10:
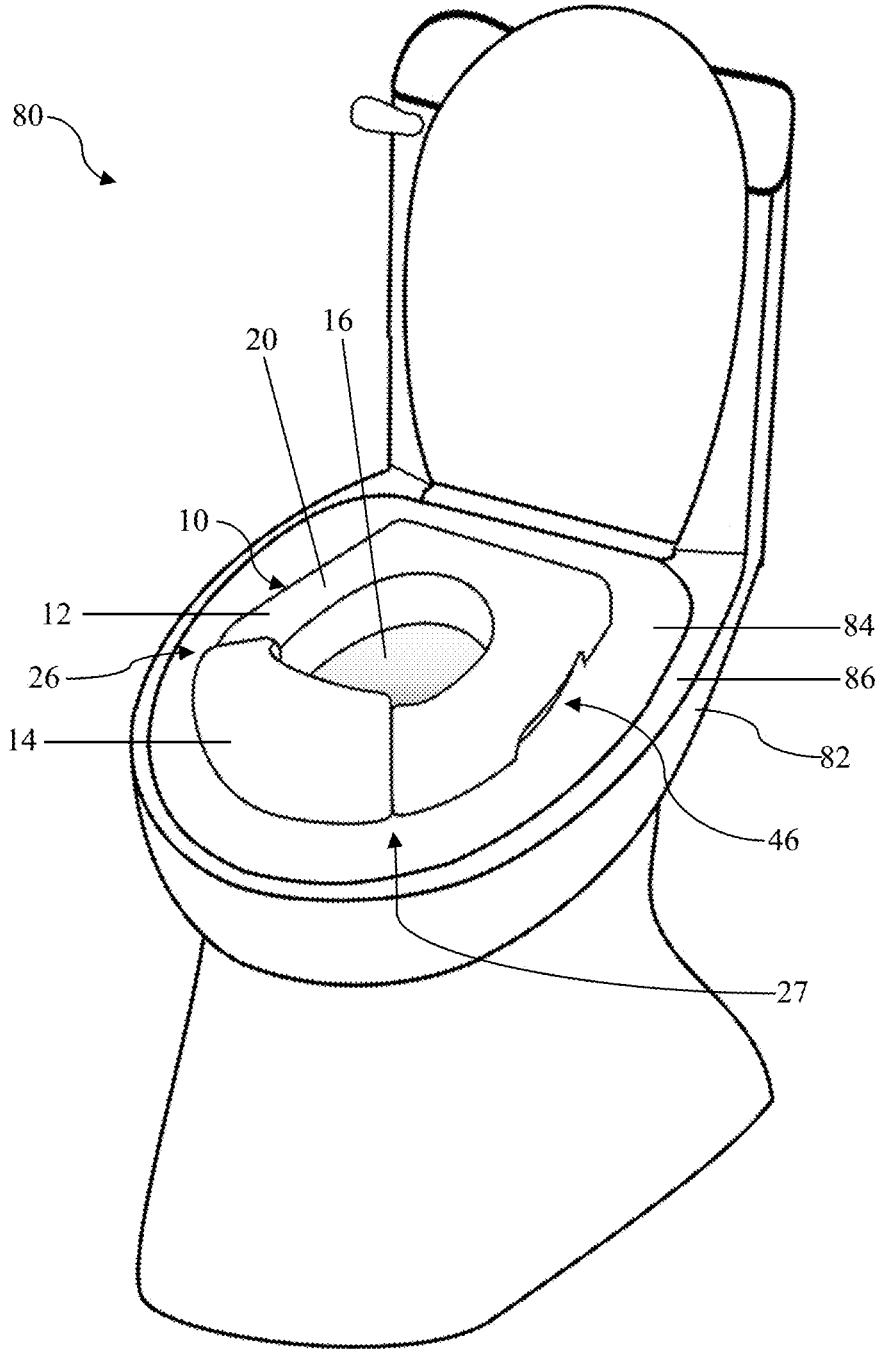
FIG. 10 is a perspective view of an embodiment of the toilet seat apparatus of the present disclosure resting on a toilet seat of a toilet.

One aspect of the present disclosure, as shown in FIGS. 1-4, is a toilet seat apparatus 10 for children. The toilet seat apparatus 10 may be lightweight and portable such that it can be positioned above a toilet bowl 82 of a toilet 80, as shown in FIG. 10, or on a toilet chair, as shown in FIG. 8. The toilet seat apparatus 10 includes a first seat member 12 and a second seat member 14 detachably connected to the first seat member 12. The apparatus further includes an aperture 16 that extends through the apparatus 10 when the first and second seat members 12 and 14 are connected. The aperture 16 is generally annular, and detaching the second seat member 14 from the first seat member 12 provides access to the aperture 16 by forming a gap in the annular ring of the apparatus 10. While the embodiment depicted in the Figures shows only two seat members, the apparatus 10 may include three or more seat members that form the aperture when connected.

Any suitable type of connection may be employed to connect the first and second seat members 12 and 14, and thus providing access to the aperture may be accomplished by either complete or partial detachment of the second seat member 14 from the first seat member 12, as further described below. Providing access to the aperture 16, as used herein, includes creating radial access 18 to the aperture 16 where no such radial access 18 existed previously, as well as providing circumferential access to the aperture; i.e., enlarging the aperture. Radial access 18, as used herein, means access to the aperture 16 from a point defining the circumference of the aperture 16 when the first and second seat members 12 and 14 are connected. Providing access to the aperture 16 includes removing a portion of the apparatus 10 to provide a gap in the annular aperture 16 to allow a user to remove the first seat member 12 from a child's head or neck.

Figure 3:
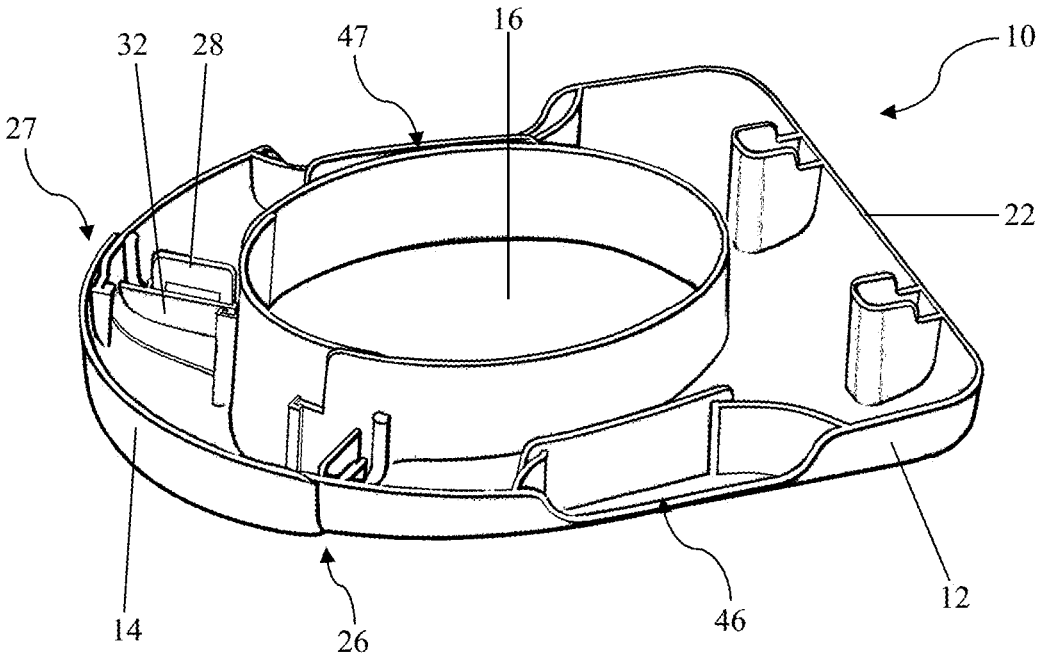
FIG. 3 is a bottom perspective view of the apparatus of FIG. 1.
Figure 4:
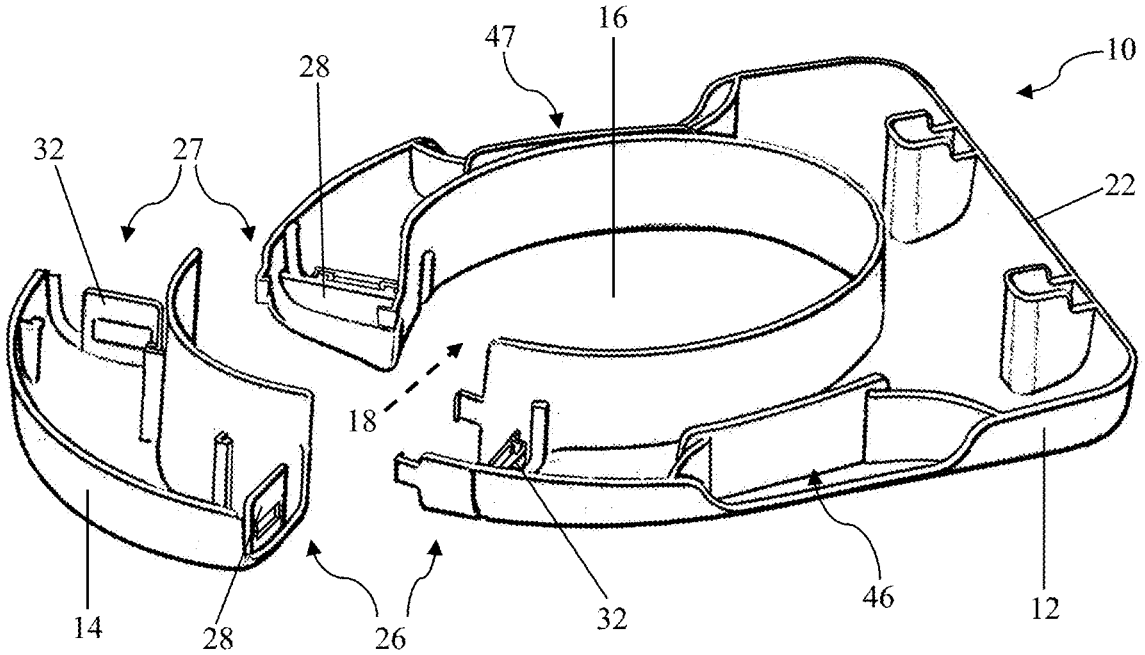
FIG. 4 is an exploded bottom perspective view of the apparatus of FIG. 1.
Figure 5A:
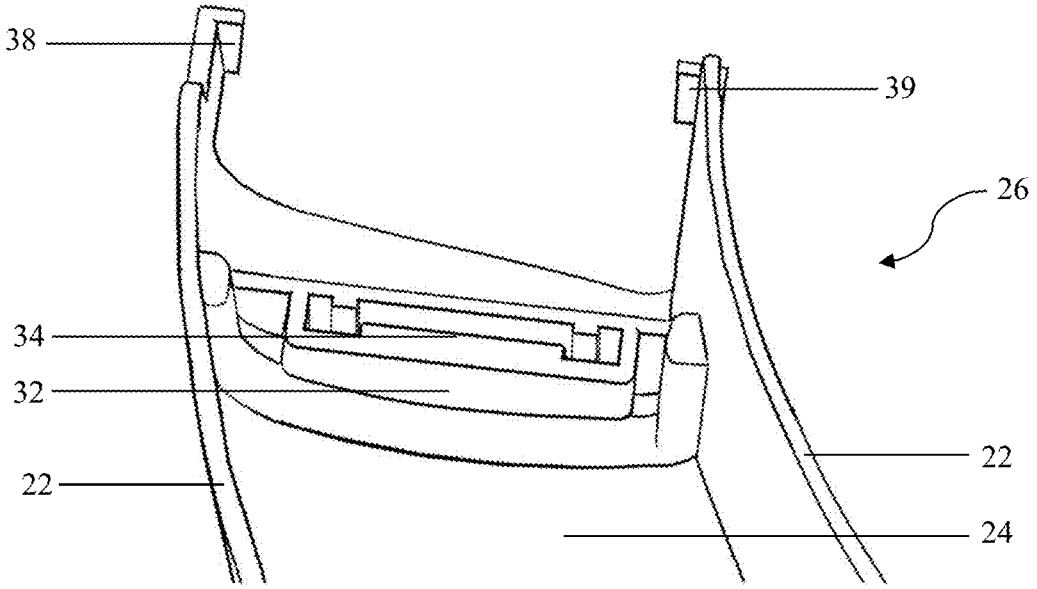
FIG. 5A is a detailed bottom view of an latch of a first seat member of the present disclosure.
Figure 5B:
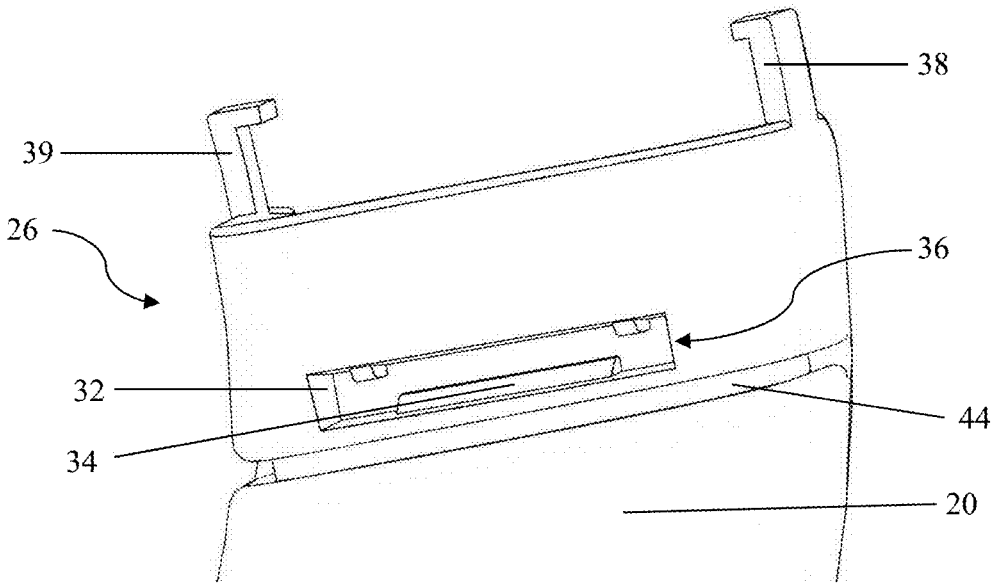
FIG. 5B is a detailed top view of the latch of FIG. 5A.
Figure 6:
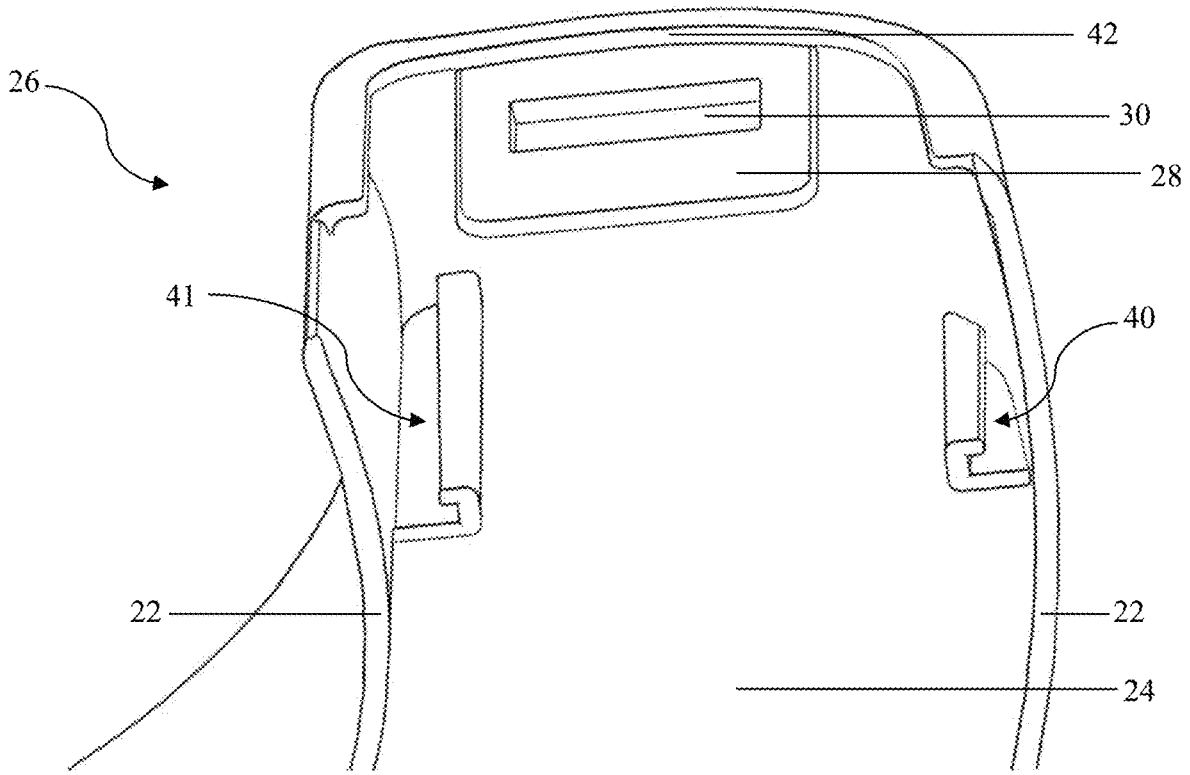
FIG. 6 is a detailed bottom view of an embodiment of an latch of a second seat member of the present disclosure.

The toilet seat apparatus 10 has a seat top surface 20 and a seat bottom surface 22, and, in some embodiments, may be hollow and have a seat inner surface 24. In some embodiments, the seat bottom surface 22 may include two or more separate portions, as shown in FIGS. 3 and 4, while in other embodiments the seat bottom surface may be a single continuous surface that encloses the interior of the apparatus 10. As noted, in some embodiments, the toilet seat apparatus 10 can be positioned above the toilet bowl 82 of an ordinary toilet 80 such that the entirety of the aperture 16 is positioned above the toilet bowl 82. The seat bottom surface 22 of the apparatus 10 may be configured to rest on, in some embodiments, a toilet seat 84 of the toilet 80 or, in other embodiments, a toilet bowl rim 86 of the toilet 80. Positioning the apparatus 10 such that the aperture 16 is above the toilet bowl 82 allows for a child to use the toilet seat apparatus 10 in conjunction with the entirety of the toilet 80; that is, the child's excrement can pass through the aperture 16 and into the toilet bowl 82 from where it may be flushed. Thus, a child may be taught proper etiquette for using the toilet 80, including flushing the toilet 80 after use, even when the child is too small to sit on the toilet seat 84.

Though the intended purpose of toilet training toilet seats similar to the toilet seat apparatus 10 is to teach young children to use a conventional toilet 80, and this intended use poses no safety concerns, children are prone to using toilet training seats in a manner that can be dangerous to the child. The detachability of the second seat member 14 from the first seat member 12 to provide access to the aperture 16 is an enhancement to the safety of the apparatus 10 when it is used other than for its intended purpose. If a child pulls the toilet seat apparatus 10 over his head and around his neck, as children are sometimes inclined to do, conventional toilet training toilet seats generally cannot be removed by sliding the seat up from the child's neck and back over his head. The access to the aperture 16 provided by removing second seat member 14 from first seat member 12, as further described herein, may allow quick, easy, painless removal of the apparatus 10 without causing damage to the apparatus 10 or the child, as the apparatus 10 need not be cut with a sharp tool or broken by significant force to be removed. Further, once detached, the first and second seat members 12 and 14 can be reconnected to reform the aperture 16, and the apparatus 10 may be used again for its intended purpose of toilet training children.

The toilet seat apparatus 10 has two latches 26 and 27 at which the first seat member 12 contacts the second seat member 14 when the seat members 12 and 14 are connected. As shown in FIGS. 3 and 4, in some embodiments, the second seat member 14 can be completely detachable from the first seat member 12 to provide radial access 18 to the aperture 16. Complete detachment of the second seat member 14 from the first seat member 12, as used herein, means the seat members 12 and 14 do not contact each other and no element or combination of elements otherwise links the seat members 12 and 14 together. In other embodiments, the second seat member 14 may be partially detachable from the first seat member 12 to provide access 18 to the aperture 16. Partial detachment of the second seat member 14 from the first seat member 12, as used herein, means the seat members 12 and 14 are disconnected at one or more locations, but may still be in contact at other locations or otherwise linked via another element or elements of the apparatus 10.

Figure 2:
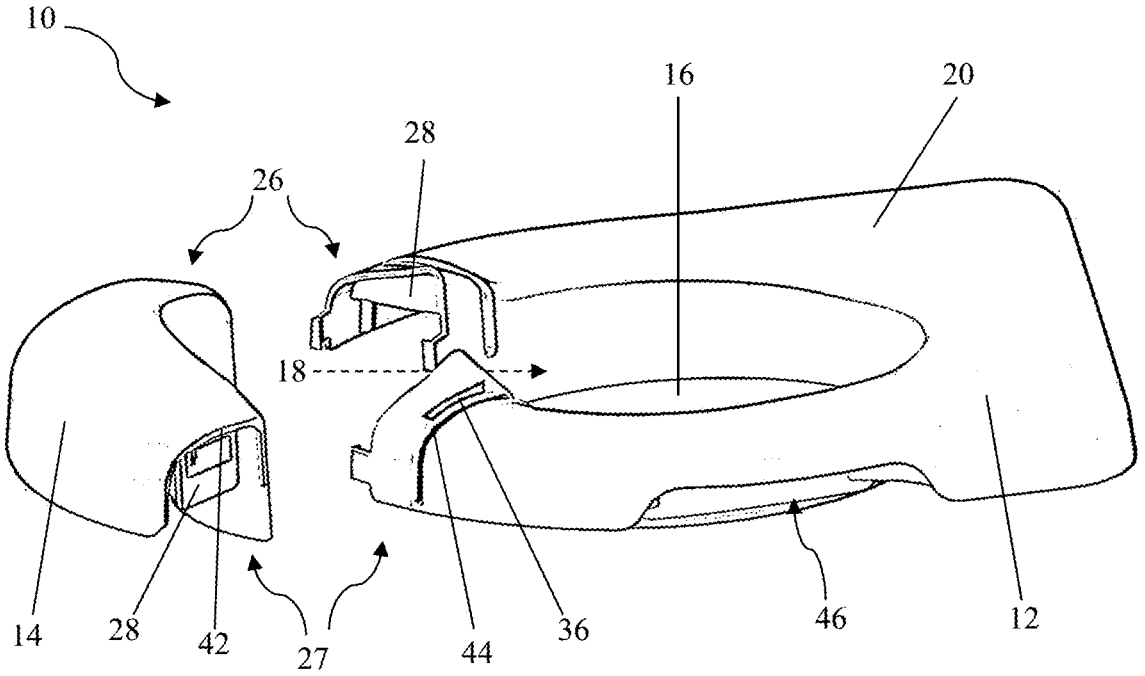
FIG. 2 is an exploded top perspective view of the apparatus of FIG. 1.

In some embodiments, as shown in FIGS. 1-7, the first and second seat members 12 and 14 may be detachably connected at each of the two latches 26 and 27. In such embodiments, the seat members 12 and 14 may be completely detachable at both latches 26 and 27. For example, FIGS. 2 and 4 show seat members 12 and 14 completely detached at both latches 26 and 27 and the radial access 18 thereby created. In other embodiments, the seat members 12 and 14 may be partially detachable at both latches 26 and 27. For example, the first and second seat members 12 and 14 may be connected via one or more linking members, such as a drawer slide or, which can allow the seat members 12 and 14 to be detached from each other, yet still connected via the linking member, such the aperture becomes formed by the seat members 12 and 14 and the linking member or members. In such embodiments, access to the aperture 16 may be provided circumferentially. Still, in other embodiments, the first and second seat members 12 and 14 may be detachably connected at only one latch 26 or 27 and merely in contact at the other latch 27 or 26 such that the seat members 26 and 27 are partially detachable. For example, a hinge may connect the seat members 12 and 14 at one latch 26 or 27. The hinge may allow the second seat member 14 to swing away from the first seat member 12 or vice versa, either upward, downward, or outward, thereby providing radial access 18 to the aperture 16.

Providing access to the aperture 16, whether radially or circumferentially, can allow objects that would otherwise be stuck within the aperture 16 when the seat members 12 and 14 are connected to freely move outside of the aperture 16. Importantly, if a child pulls the toilet seat apparatus 10 over his head such that his neck becomes stuck within the aperture 16, providing radial access 18 to the aperture 16 may allow the child's neck to pass through the points of radial access 18, and providing circumferential access to the aperture 16 may allow the child's head to pass through the aperture 16 itself.

Notably, regardless of whether the seat members 12 and 14 are connected at one or both of the latches 26 and/or 27, in some embodiments, the first seat member 12 may be substantially flush with the second seat member 14 at each of the two latches 26 and 27. In ordinary use of the toilet seat apparatus 10 for its intended purpose, a child's legs will be in direct contact with the seat top surface 20. If there is a gap between the first and second seat members 12 and 14, the skin of the child's legs may be pinched, causing pain and irritation. Thus, it can be important to configure the seat members 12 and 14 such that they are flush at each latch 26 and 27 such that there is no gap between the seat members 12 and 14 capable of pinching the user's skin.

As previously noted, any suitable type of connection or fastener may be employed to detachably connect the first and second seat members 12 and 14 at one or both of the latches 26 and/or 27. In some embodiments, such as those depicted in FIGS. 4-7, there can be a male-female connection between the first and second seat members 12 and 14. At each latch 26 and 27, the toilet seat apparatus 10 may include a male member 28 located on either the first or second seat member 12 or 14 and a female member 32 located on the opposing seat member 14 or 12 and configured to receive the corresponding male member 28 at the latch 26 or 27. FIGS. 4-7 show each male member 28 being located on the second seat member 14 and each female member 32 being located on the first seat member 12, but are not intended to limit the apparatus 10 to this configuration. Further, each of the first and second seat members 12 and 14 may include a plurality of female and/or male members 32 and 28, and each female member 32 may be configured to receive a corresponding male member 28 located on the opposing seat member 14 or 12 at each latch 26.

Figure 7:
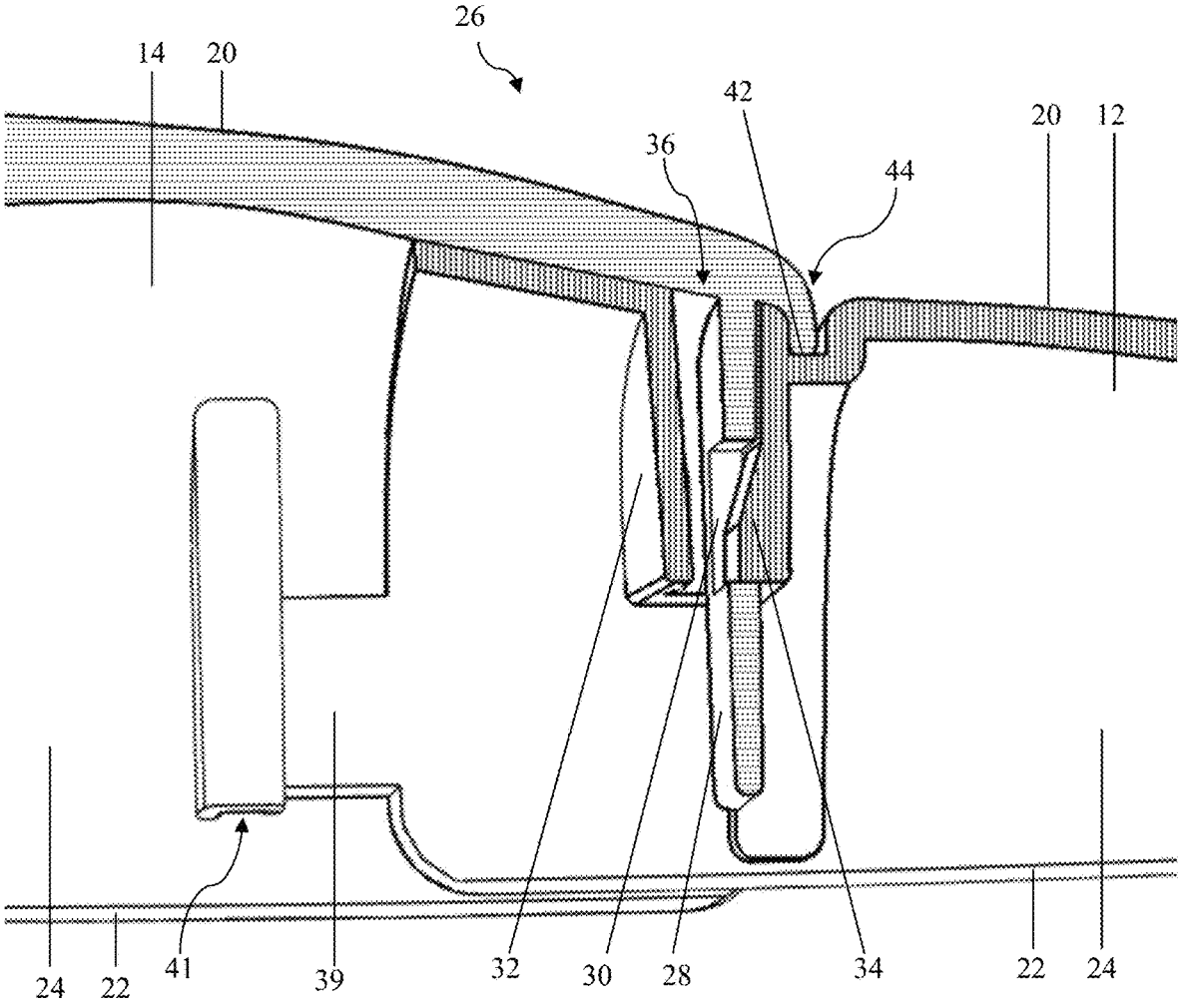
FIG. 7 is a partial cross-section view of an embodiment of an latch of the apparatus of the present disclosure showing two seat members connected together.

In some embodiments employing a male-female type connection, each male and female member 28 and 32 may extend downwardly from the seat inner surface 24 of the respective seat member 12 or 14 on which it is located. Further, each female member 32 may have a female member entrance 36 located on the seat top surface 20 such that each male member 28 may be received in the corresponding female member 32 through the female member entrance 36. In such embodiments, the second seat member 14 may be connectable to the first seat member 12 by downwardly inserting each male member 28 into the corresponding female member 32 through the female member entrance 36. And, because each male and female member 28 and 30 extends from the seat inner surface 24 of the respective seat member 12 or 14 on which is located, the seat top surface 20 may be substantially continuous between the first and second seat members 12 and 14, as depicted in FIGS. 1 and 7. When the first and second members 12 and 14 are substantially flush and the seat top surface is substantially continuous, there is the least amount of risk that the apparatus 10 may pinch a child user's legs.

In some embodiments, each male member 28 may be detachable with the corresponding female member 32. In such embodiments, when each male member 28 is engaged with the corresponding female member 32, the second seat member 14 is fixed in place in relation to the first seat member 12, and when each male member 28 is disengaged from the corresponding female member 32, the second seat member 14 is detachable from the first seat member 12. As shown in detail in FIGS. 5A-7, in some embodiments, each male member 28 may include a notch 30 and each female member 32 may include a camber 34 configured to engage with the corresponding notch 30. In some embodiments, each notch 30 may extend through the male member 28 to create a hole through the male member 28, though in other embodiments, it may only extend partially through the male member 28. Further, the male member 28 may be flexible.

To provide additional stability at each latch 26 and 27, in some embodiments, the toilet seat apparatus 10 may further include, at each latch 26 and 27, a pair of teeth 38 and 39 located on either the first or second seat member 12 or 14 and a pair of receptacles 40 and 41 located on the opposing seat member 14 or 12 and configured to receive the corresponding pair of teeth 38 and 39 at the latch 26 or 27. In some embodiments, each tooth 38 and 39 and each receptacle 40 and 41 may be disposed on opposing sides of the seat inner surface 24, as shown in FIGS. 3-6. In embodiments that include both a male-female connection and corresponding pairs of teeth 38 and 39 and receptacles 40 and 41, the angle at which each pair of teeth 38 and 39 is slidable into the corresponding pair of receptacles 40 and 41 can be the same angle at which each female member 32 is insertable into the corresponding male member 28, allowing for attachment and detachment of the seat members 12 and 14 in a single continuous motion.

In some embodiments, for further stability and continuity of the seat top surface 20 between the seat members 12 and 14, at each latch, either the first or second seat member 12 or 14 may have an outer edge 42 and the opposing seat member 14 or 12 may further comprise a groove 44 configured to receive the outer edge 42 of the first or second seat member 12 or 14. In some embodiments, the groove 44 may be located on the seat top surface 20 of the first or second seat member 12 or 14. In other embodiments, such as those wherein the seat bottom surface 22 is a single continuous surface enclosing the interior of the apparatus 10, the groove 44 may be located on the seat bottom surface 22.

In the preferred embodiment, the apparatus 10 includes completely detachable first and second seat members 12 and 14 connected at both latches 26 and 27 via a male-female connection. Each male member 28 of the second seat member 14 is received within the corresponding female member 32 of the first seat member 12 in an insertion direction, and the corresponding cambers 24 and notches 30 are engaged. In this configuration, the teeth 38 and 39 of the first seat member 12 are received within the receptacles 40 and 41 of the second seat member 14 in the insertion direction and the outer edge 42 of the second seat member 14 is positioned within the groove 44 of the first seat member 12.

Figure 11:
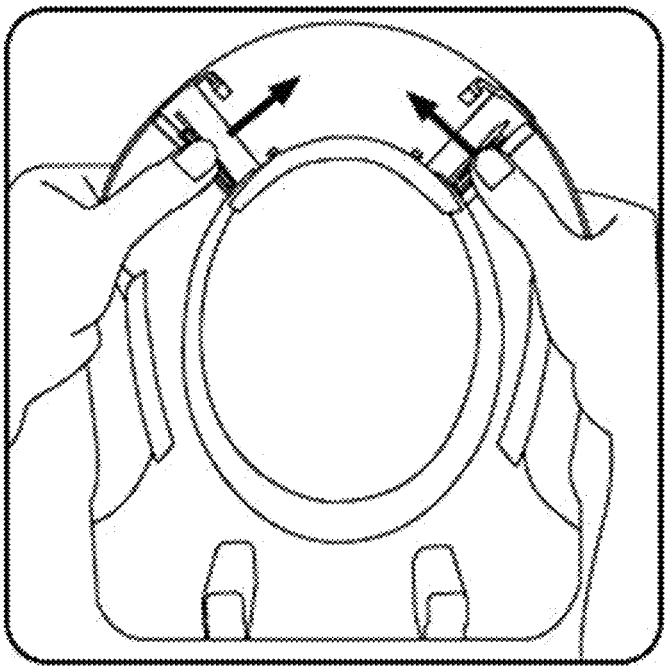
FIG. 11 is a bottom view of an embodiment of a toilet seat of the present disclosure.
Figure 12:
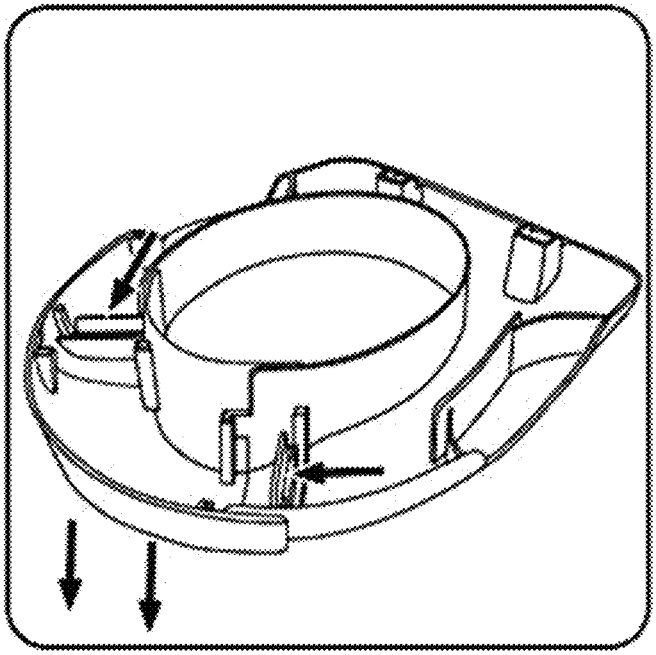
FIG. 12 is a bottom perspective view of an embodiment of a toilet seat of the present disclosure.
Figure 13:
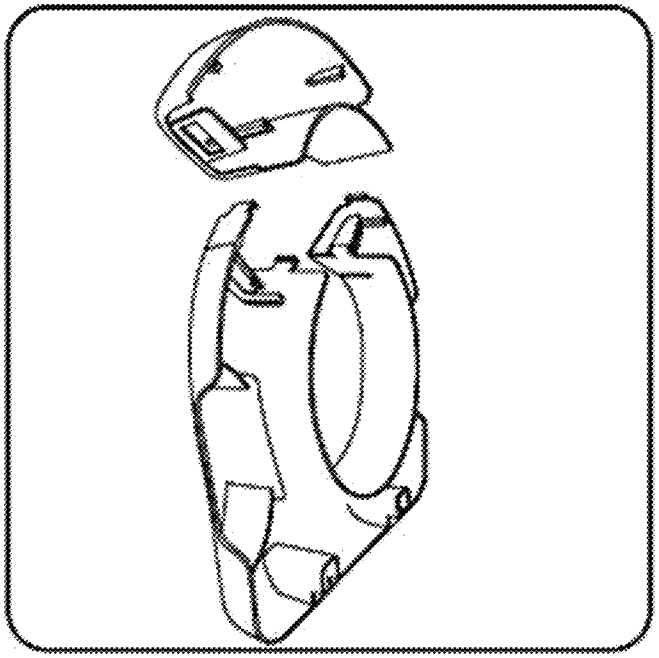
FIG. 13 is a bottom perspective view of an embodiment of a toilet seat of the present disclosure in a detached configuration.

To detach the second seat member 14, a user can push each male member 28 away from the corresponding female member 32, thereby disengaging the cambers 34 from the notches 30, as depicted in FIG. 11. Subsequently, each male member 28 can be retracted from each female member 32 by pushing the male members 28 out through the female member entrances 36 in a retraction direction that is substantially opposite from the insertion direction, as shown in FIG. 12. When the second seat member 14 is completely detached from the first seat member 12, as depicted in FIG. 13, the radial access 18 thereby created can allow for an object, such as a child's neck, that was previously stuck within the aperture 16 to pass outside of the aperture 16. After detachment, the second seat member 14 can then be reconnected to the first seat member 12. The seat members 12 and 14 can be detached and reconnected up to 400 times each without damage or decrease in usability or safety.

A child generally will sit on the seat top surface 20 of the toilet seat apparatus 10 during proper use. Children are generally toilet trained between the ages of two and four, and children under the age of five typically weigh less than sixty pounds. Accordingly, the apparatus 10 should have a rigidity such that the seat top surface 20 does not bow, concave, or otherwise bend when subjected to sixty pounds of weight or less. The rigidity of the apparatus 10 may also allow for the apparatus 10 to flex about the aperture 16 to manipulate its shape. Thus, when the apparatus 10 is used for its intended purpose, it may maintain its shape and stability, but when the apparatus 10 is improperly used and pulled around a child's neck, it can be flexed or twisted to safely accommodate the shape of a child's neck during removal. The apparatus 10 may also, in some embodiments, include a pair of seat handles 46 and 47 for ease of picking up the apparatus 10. The seat handles 46 and 47 should be located away from the aperture 16, where excrement passes through, to allow for sanitary transportation of the apparatus 10. In some embodiments, the seat handles 46 and 47 may form portions of the seat bottom surface 22, as shown in FIGS. 1-4, while in other embodiments they may extend outward from the apparatus 10.

A second aspect of the present disclosure is a toilet chair apparatus 50 including a base 52, having a base cavity 54 and a base surface 56, and a toilet seat assembly 58 substantially the same as the toilet seat apparatus 10 disclosed herein and removably positionable on the base surface 56. For convenience, all named and numbered elements of the toilet seat apparatus 10 described herein can be considered elements of the toilet seat assembly 58. For clarity, all references to "the apparatus" hereinafter refer to the toilet chair apparatus 50. Toilet chairs, and the many features and benefits of using toilet chairs to toilet train children, are well-known in the art and thus shall not be further discussed herein.

In some embodiments, the base 52 may include a base tank 58 such that the toilet chair apparatus 50 resembles a conventional toilet 80. In some embodiments, the base cavity 54 may extend throughout the entirety of the base 52 such that the base 52 is substantially hollow. In other embodiments, the base cavity 54 may only extend into a portion of the base 52. The base surface 56 may be substantially flat and parallel to the floor such that it resembles a wide toilet bowl rim 86 and provides a seat for the toilet seat assembly 58.

Figure 9:
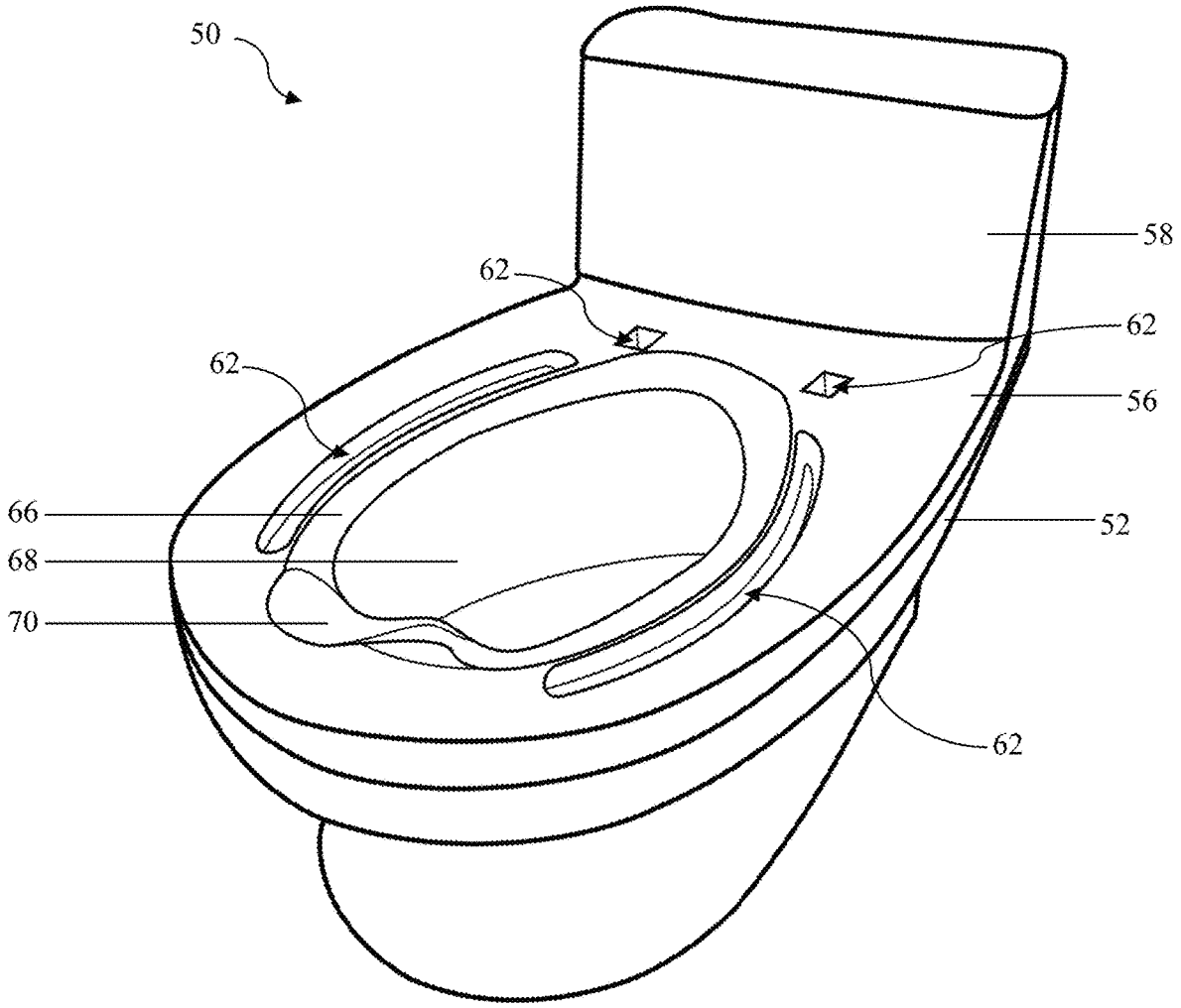
FIG. 9 is a perspective view of the toilet chair of FIG. 8 showing the toilet seat removed.

In some embodiments, as shown in FIG. 9, the toilet chair apparatus 50 may further include at least one recess 64 located on the base surface 56 configured to receive the seat bottom surface 22 of the toilet seat assembly 58. In some embodiments wherein the seat bottom surface 22 includes two or more separate portions, the base surface 56 can include a plurality of recesses 64 configured to receive corresponding portions of the seat bottom surface 22. For example, in embodiments wherein the seat handles 46 and 47 of the toilet seat assembly 58 form portions of the seat bottom surface 22, the base surface 56 may include recesses 64 configured to receive the seat hands 46 and 47. Placing the seat bottom surface 22 or portions thereof into the recesses 64 can provide additional stability when the toilet seat assembly 58 is positioned on the base surface 56.

The toilet chair apparatus 50 may further include, in some embodiments, a removable tub 64. In some embodiments, when the toilet seat assembly 60 is positioned above the tub 64, the aperture 16 provides access to the tub 64 and does not provide access to the base cavity 54. Thus, a child can sit on the toilet seat assembly 60 and expel excrement through the aperture 16 into the tub 64, which may thereafter be removed from the apparatus 50, emptied, and cleaned. This allows for easier disposal of a child user's excrement than if the child were to expel directly into the base cavity 54. For ease of placement on the base 52, the tub 64 may have a rim portion 66 and a bowl portion 68. In some embodiments, the rim portion 66 may be configured to rest on the base surface 56 such that the bowl portion 68 is at least partially positioned within the base cavity 54. In some embodiments wherein the base cavity 54 only extends into a portion of the base 52, the bowl portion 68 may be configured to rest completely within the base cavity 54.

The tub 64 may further include a pan handle 70. The pan handle 70 can extend from the rim portion 66 and away from the bowl portion 68 such that it is unlikely or impossible for any child excrement to be expelled onto the pan handle 70. Thus, the tub 64 can be sanitarily removed from the apparatus 50 using the pan handle 70.

Thus, although there have been described particular embodiments of the present invention of a new and useful Toilet Trainer, it is not intended that such references be construed as limitations upon the scope of this invention.

What is claimed is:

1. A toilet seat apparatus, comprising:

a first seat member;

a second seat member detachably connected to the first seat member forming an annular ring; and an aperture extending through the apparatus when the first and second seat members are connected, wherein detaching the second seat member from the first seat member provides access to the aperture.

2. The apparatus of claim 1, wherein the second seat member is completely detachable from the first seat member to provide radial access to the aperture.

3. The apparatus of claim 1, further comprising a first latch disposed at a first end of the second seat member, wherein the first latch provides a detachable engagement between the first seat member and the second seat member.

4. The apparatus of claim 3, further comprising a second latch disposed at a second end of the second seat member, wherein the second latch provides a detachable engagement between the first seat member and the second seat member.

5. The apparatus of claim 4, wherein the first seat member is substantially flush with the second seat member at each of the first and second latches.

6. The apparatus of claim 4, wherein the first and second seat members are detachably connected at the first and second latches.

7. The apparatus of claim 6, wherein the first and second seat members are configured to reconnect the first seat member to the second seat member via the first and second latches.

8. The apparatus of claim 6, further comprising a male member located on the second seat member and a female member located on the first seat member configured to receive the corresponding male member at the first latch.

9. The apparatus of claim 8, wherein the male member is removably engageable with the corresponding female member such that when the male member is engaged with the female member, the second seat member is fixed in place in relation to the first seat member.

10. The apparatus of claim 9, wherein the male member further comprises a notch and the female member further comprises a camber configured to engage with the notch of the corresponding male member.

11. The apparatus of claim 6, further comprising a pair of teeth located on the first seat member and a pair of receptacles located on the second seat member and configured to receive the corresponding pair of teeth.

12. The apparatus of claim 6, wherein the second seat member has an outer edge and the first seat member further comprises a groove configured to receive the outer edge of the second seat member.

13. A toilet seat apparatus, comprising:

a first seat portion;

a second seat portion;

first and second latches at which the first and second seat portions are detachably connected and at each of which the second seat portion includes a male member and the first seat portion includes a female member configured to receive the corresponding male member at each latch; and an aperture extending through the apparatus when the first and second seat portions are connected, wherein removing the male members from the corresponding female members detaches the second seat portion from the first seat portion and provides radial access to the aperture.

14. A toilet chair apparatus, comprising:

a base having a base cavity and a base surface; and a toilet seat assembly removably positionable on the base surface comprising a first seat member and a second seat member that form an aperture when connected, wherein the first and second seat members of the toilet seat assembly are detachable.

15. The apparatus of claim 14, wherein the toilet seat assembly has a seat bottom surface, further comprising at least one recess located on the base surface configured to receive the seat bottom surface.

16. The apparatus of claim 14, further comprising a removable tub.

17. The apparatus of claim 16, wherein when the toilet seat assembly is positioned above the tub, the aperture provides access to the tub and does not provide access to the base cavity.

18. The apparatus of claim 16, wherein the tub has a rim portion and a bowl portion, the rim portion configured to rest on the base surface such that the bowl portion is at least partially positioned within the base cavity.

19. The apparatus of claim 16, wherein the tub further comprises a pan handle.

20. A method for removing an object stuck within an aperture of a toilet seat, the toilet seat having a first and a second seat member that are detachably connected and that form the aperture when connected, the method comprising:

detaching the first and second seat members, thereby creating a radial access to the aperture; and passing the object from within the aperture to outside the aperture via the radial access.

* * * * *